US005481844A

United States Patent [19]

Kajita

[11] Patent Number: 5,481,844

[45] Date of Patent: Jan. 9, 1996

[54] JOINT PART FOR USE IN WOODEN BUILDINGS

[75] Inventor: Yusuke Kajita, Hokkaido, Japan

[73] Assignee: Kajita Construction Company, Hokkaido, Japan

[21] Appl. No.: 165,032

[22] Filed: Dec. 9, 1993

Related U.S. Application Data

[62] Division of Ser. No. 915,420, Jul. 17, 1992, Pat. No. 5,337,533.

[30] Foreign Application Priority Data

Oct. 31, 1991 [JP] Japan ..... 3-286514
Oct. 31, 1991 [JP] Japan ..... 3-286515

[51] Int. Cl.[6] ..... E04B 1/38; F16B 1/00

[52] U.S. Cl. ..... 52/702; 52/92.2; 52/745.12; 52/745.21

[58] Field of Search ..... 52/702, 713, 715, 52/92.2, 92.3, 712, 745.12, 745.21, 741.1, 92.1; 403/233, 234, 237; 248/218.1–220.1

[56] References Cited

U.S. PATENT DOCUMENTS

| | | | |
|---|---|---|---|
| 828,488 | 8/1906 | Lanz | 52/702 X |
| 1,019,778 | 3/1912 | Fredrickson | 248/218.4 X |
| 1,097,934 | 5/1914 | Price | 52/702 X |
| 3,256,030 | 6/1966 | Banse | 52/712 X |
| 3,537,221 | 11/1970 | Helfman et al. | 52/702 X |
| 4,198,175 | 4/1980 | Knepp et al. | 52/702 X |
| 5,104,252 | 4/1992 | Colonias et al. | 52/702 X |
| 5,111,632 | 5/1992 | Turner | 52/702 |

OTHER PUBLICATIONS

1982 Sweet's Catalog Fie 66 Connectors & Supports.

*Primary Examiner*—Robert J. Canfield
*Attorney, Agent, or Firm*—Darby & Darby

[57] ABSTRACT

This invention provides a process for an improved wooden building in a zone of cold, which comprises a continuous footing having a vertical heat insulation layer along the footing and a horizontal heat insulation layer integrally formed within a slab floor, a sill anchored to the continuous footing, columns erected on the sill with frameworks such as cross-beam and partition cap elements mounted on the columns by means of a metallic joint part, a ceiling with an airtight sealing materials, a roofing, exterior and interior walls with a heat insulation, and others.

4 Claims, 12 Drawing Sheets

JOINT PART FOR USE IN WOODEN BUILDINGS

This is a division of application Ser. No. 07/915,420, filed Jul. 17, 1992 now U.S. Pat. No. 5,337,533 issued Aug. 16, 1994.

BACKGROUND OF THE INVENTION

1. Field of the Invention

The present invention relates to an improved wooden building for a zone of cold, particularly a wooden building constructed on a foundation including an improved slab-floor having both a heat insulation and a moisture proof, and more particularly a wooden building constructed by means of an improved framework.

2. Description of the Prior Art Conventionally, it is known in the slab-floor art for a zone of cold and disclosed in Japanese patent provisional publication No. Hei 1-268945 that a plurality of moisture-proof sheets are fully covered over a flat ground of lot area including a lot of sequent continuous footing, after that a plurality of hard type foam boards, which is made of a synthetic resin and comprising each foam cell to be an independent type foam, are closely spread out by way of a butt joint all over the ground covered by the sheets so as to form a heat insulation layer, and a continuous footing work is carried out on the form board floor, and finally a slab work is carried out on the form board surrounded by the continuous footing.

According to the slab-floor of the above Japanese document, however, in view of an energy conservation, it is disadvantageous that the horizontal surface of the slab-floor is well insulated due to the existence of the foam board under the slab, however, its vertical surface, i.e., the outer wall surface of the continuous footing is directly exposed to the environmental soil without any heat insulation.

This feature of the Japanese document, i.e., to have not any heat insulation between the outer wall surface of the continuous footing and the environmental soil is obviously disadvantageous in a zone of cold, because according to the height of a geographic latitude, it is unavoidable that a ground depth of frost penetration reaches 60 cm to 120 cm in the winter, consequently a large amount of a heat loss from the slab-floor to the environment through the continuous footing is unavoidable and serious.

For example, the interior surfaces of cooled down continuous footing and also the floor face of the slab which communicates with a warm indoor air, which will condense a lot of moisture from the warm indoor air to result to spoil their sills or wooden basements or floor materials.

In addition, the continuous footing itself adsorbs a moisture from both orientations such as the environmental soil and a condensed water in the interior, consequently an adsorbed and contained water within the continuous footing is very often frozen over and then causes many cracks to result to utterly spoil the continuous footing.

Generally, in a wooden building such as a dwelling house, it requires to provide a floor space between a living floor and a ground floor face in a humid area such as Japan to ventilate the air of the floor space in view of the prevention of rotting the sills or wooden basements or floor materials, or of growing a mold, a fungus and a toadstool, or from the attack of a white ant or a brown rat. This fact obstructs the requirements of a heat insulation and airtightness of the floor space under the living floor even though the slab-floor art of the Japanese prior art No. Hei 1-268945 would be adopted in the discussing model.

In addition, this obstacle to the requirements of a heat insulation and airtightness are also seen in a conventional structure of a framework to be based on a conventional continuous footing through sills or horizontal members.

SUMMARY OF THE INVENTION

The present invention is directed to the provision of an improved wooden building adapted to a zone of cold comprising: (1) a slab-floor having both a heat insulation and a moisture proof to be free from any moisture trouble upon sills or wooden basements for frameworks without any preparation of a floor space between a living floor and slab face to obstruct the heat insulation and moisture proof; and (2) frameworks provided to reduce a gap or difference in grade which is conventionally provided between cross-beam element and ceiling element or partition cap element and ceiling element by making low the arranging level of the cross-beam element or partition cap element to the top end of columns, to which is effective for intensifying an airtightness between them, and also to reduce a gap or difference in grade of sills and its relating horizontal members by providing a metallic joint part to fix beams to cross-beams or partition caps.

OBJECTS AND ADVANTAGES OF THE INVENTION

It is a general object of the invention to provide an improved process for an wooden building in a zone of cold which comprising the steps of: providing a vertical heat insulation means formed integrally in form panels of a continuous footing to be adhered to the outer wall surface of said continuous footing; determining the depth of the vertical heat insulation means in proportion to a depth of frost penetration in accordance with a geographical distribution; providing a horizontal heat insulation means which is sandwiched between a ballast floor and a slab floor after a slab work; anchoring a sill to said continuous footing through a moisture proof packing; directly providing a living floor on said insulated slab floor without a ventilation space under said living floor; providing a framework of supporting the whole of an wooden building in which comprises columns erected on said sills, cross-beam elements and partition cap elements mounted on said columns by using metallic joint parts; sealing the rafters of ceiling and interior wall surfaces with a moisture proof sheet prior to a ceiling and finishing work thereof; providing a roof truss comprising struts, purlin, roof-rafters, battens, fascia boards, cant strips and roofing; and providing exterior and interior walls having respective heat insulation pads therein.

It is a more specific object of the invention to provide a process for constructing an wooden building comprising that a continuous footing and a vertical heat insulation board are integrally and simultaneously formed so as to adhere the vertical heat insulation board to the outer wall surface of the continuous footing, the continuous footing with the vertical heat insulation board in a trench is filled back with a back filling soil, a ballast is further filled on the filled soil, a moisture proof sheet is covered over the ballast, a horizontal heat insulation board is spread out all over the moisture proof sheet, floor reinforcements are worked on the moisture proof sheet, and a slab concrete is paved to make the slab floor integral with the continuous footing.

It is another object of the invention to provide a process for constructing an wooden building comprising that a sill is anchored to the continuous footing, columns are erected on the sill, cross-beam elements and partition cap elements are mounted on the columns, metallic joint parts are arranged on the cross-beam and/or partition cap elements, beam elements are mounted on the cross-beam and partition cap elements, thereafter one end or both ends of the beam element is fixed to the cross-beam and/or partition cap by means of the metallic joint parts, rafters of ceiling are stretched between the cross-beam elements themselves or the partition cap elements themselves or the cross-beam and the partition cap, and a moisture proof sheet is covered over from the bottom surface of the rafters of ceiling to the interior surface of a exterior wall.

It is still another object of the invention to provide a process for constructing an wooden building comprising that a metallic joint part comprises a C-shape part having a plurality of bolt holes and a pair of L-shape parts having a plurality of bolt holes wherein opposed both side lower edges of the C-shape parts and each upper side edge of the L-shape part are then welded together to form a metallic joint part, which is operated that one end or both ends of a beam is inserted into the-C-shaped box of the parts and fixed to the cross-beam or partition cap by nails or bolts.

It is a further object of the invention to provide a process for constructing an wooden building comprising that a floor heating comprises a heating pipe which is stretched in a zigzag line on floor reinforcements before carrying out a slab concrete work and partially connect the pipe with reinforcements by wires, thereafter the slab concrete is paved on the reinforcements together with the heating pipe which may be selected from a thermoplastic synthetic resin pipe with a flexibility such as a polyethylene pipe and the like.

DETAILED DESCRIPTION OF THE INVENTION

Figure 1:
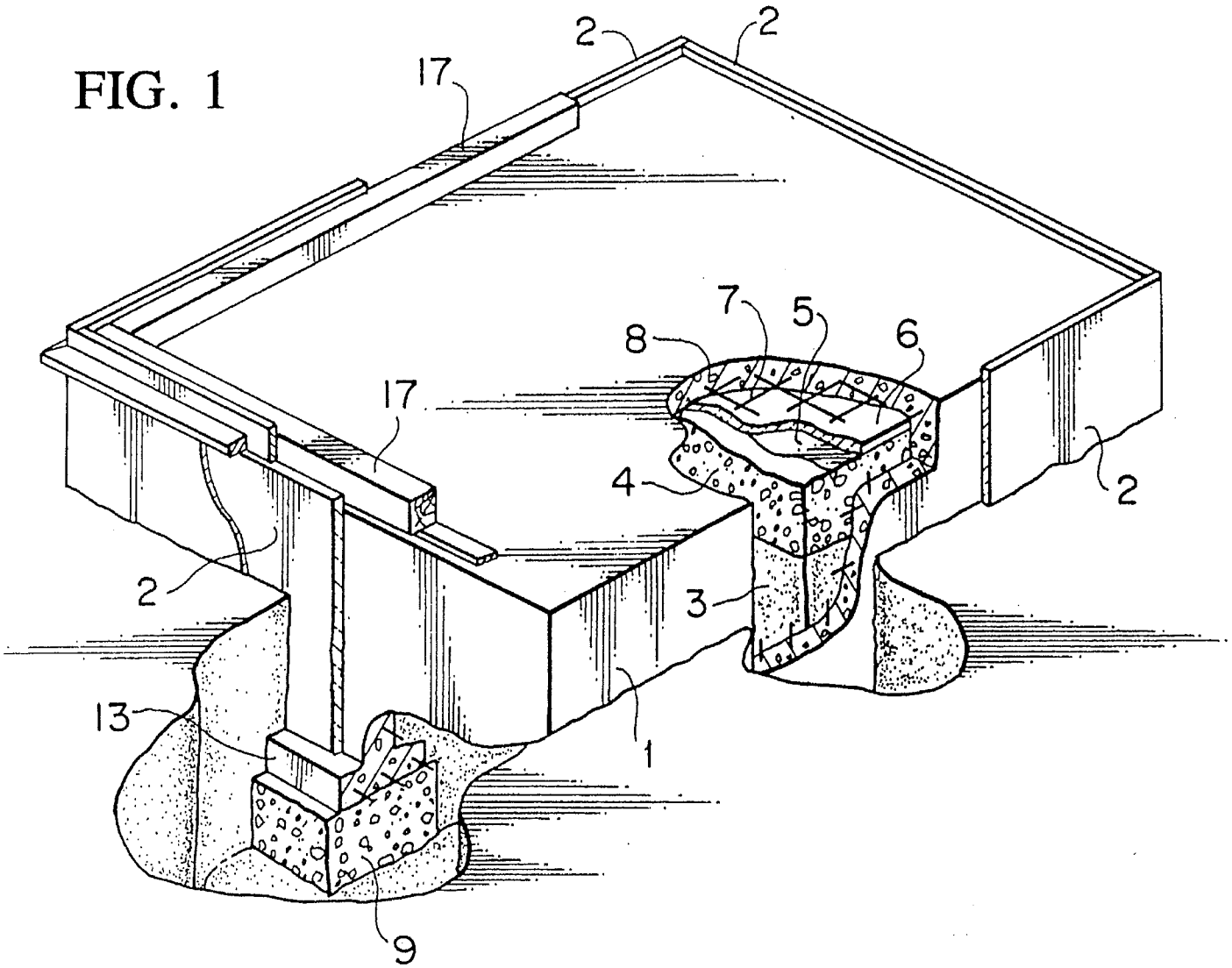
FIG. 1 shows a partially vertical perspective view of a slab floor of the present invention.

In FIG. 1 to FIG. 4, a continuous footing 1 and heat insulation board 2 (i.e. referred to a vertical insulation board 2 hereinafter) are integrally formed together with a concrete foundation 13 after rubble 9 are graveled in the bottom of a trench 10 and thereafter footing reinforcements 11 and continuous footing reinforcements 12 are worked on the rubble 9.

Figure 2A:
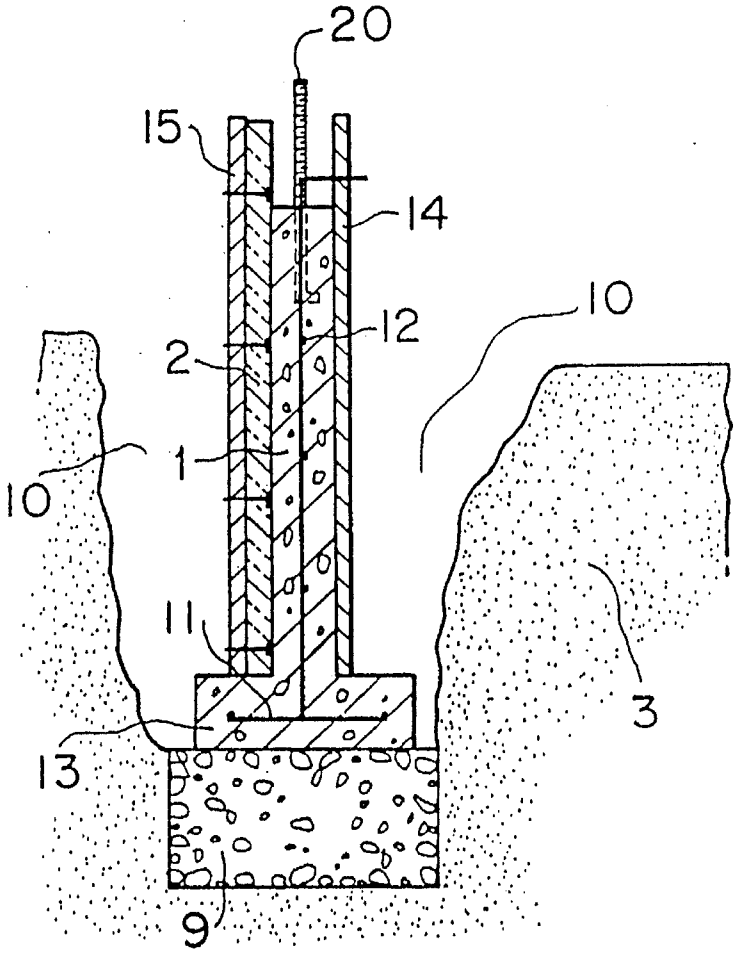
FIGS. 2A and 2B are working drawings of a continuous footing and vertical insulation board.
Figure 2B:
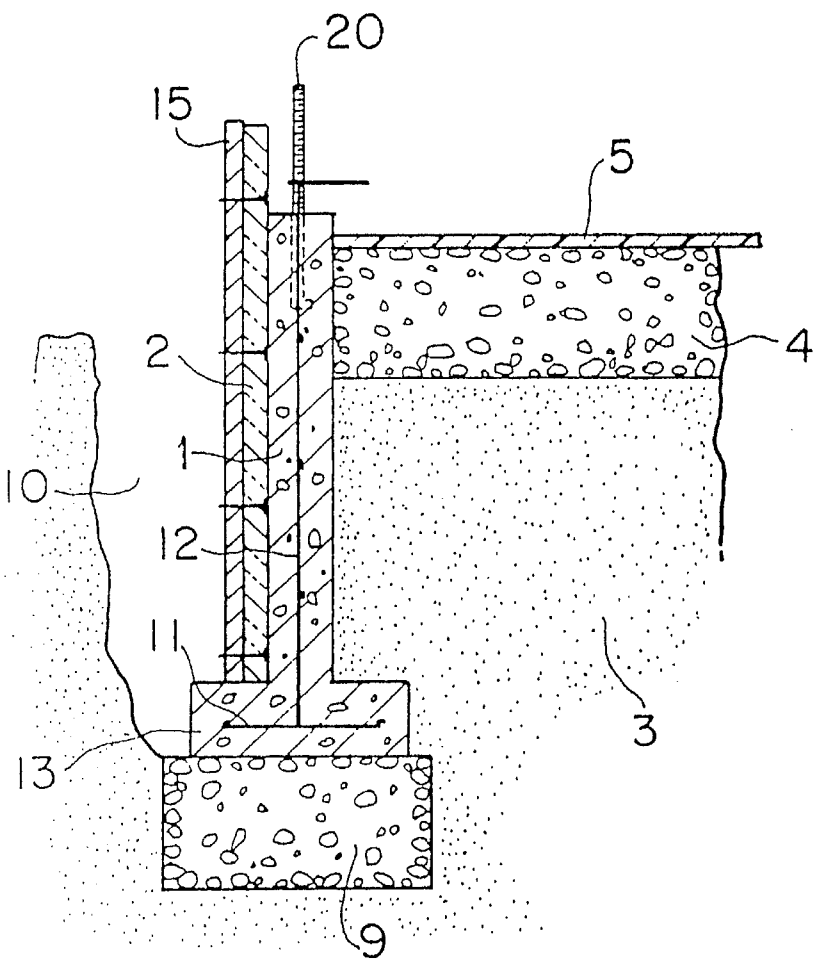

Prior to the above works, an inter form panel 14 and outer form panel 15 are constructed upright and the vertical insulation board 2 are detachably fixed to the interior of the outer form panel 15 by using nails as shown in FIGS. 2A and 2B, and then the continuous footing 1 is worked so as to adhere the vertical insulation board 2 to the inside of the outer form panel 15.

The both form panels 14 and 15 are then released from the continuous footing 1 so as to leave the vertical insulation board 2 after a prescribed period for hardening the concrete wherein the continuous footing 1 with the vertical insulation board 2 is completed.

Upon completion of the continuous footing 1 with the vertical insulation board 2, the trench 10 is filled back with a back filling soil 3 and a ballast 4 is further filled on the filled soil 3 as illustrated in FIG. 2B.

Before spreading another heat insulation board 6 (i.e., referred to as a horizontal insulation board 6) over the ballast 4, a moisture proof sheet 5 is covered over the ballast 4. The moisture proof sheet 5 may be a thermoplastic type synthetic resin sheet or film having a thickness between 0.1 mm and 1.0 mm which may be made of a vinyl chloride, a polyethylene and the like.

Figure 3A:
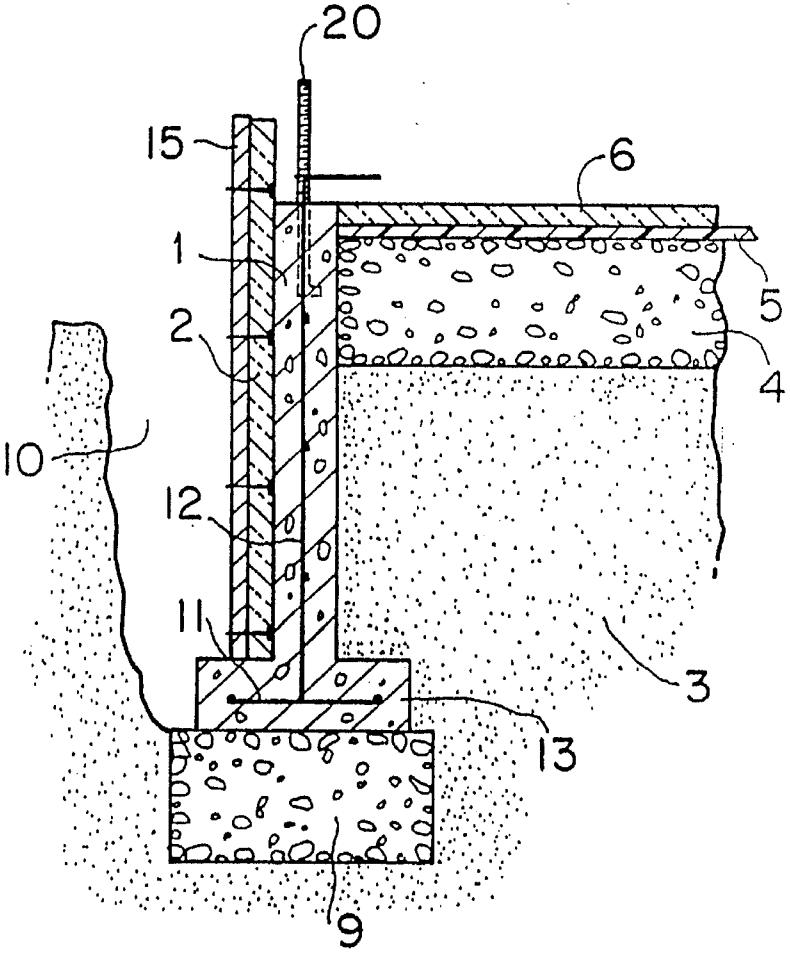
FIGS. 3A and 3B are working drawings similar to those of FIGS. 2A and 2B, but with a horizontal insulation board added.
Figure 3B:
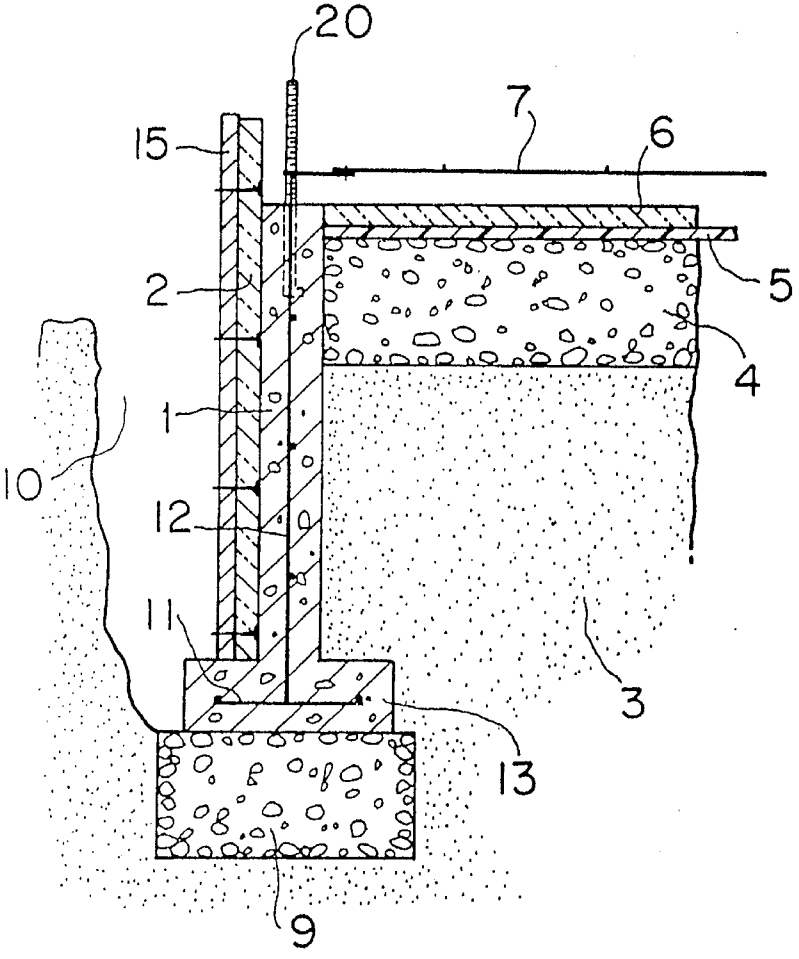
Figure 4A:
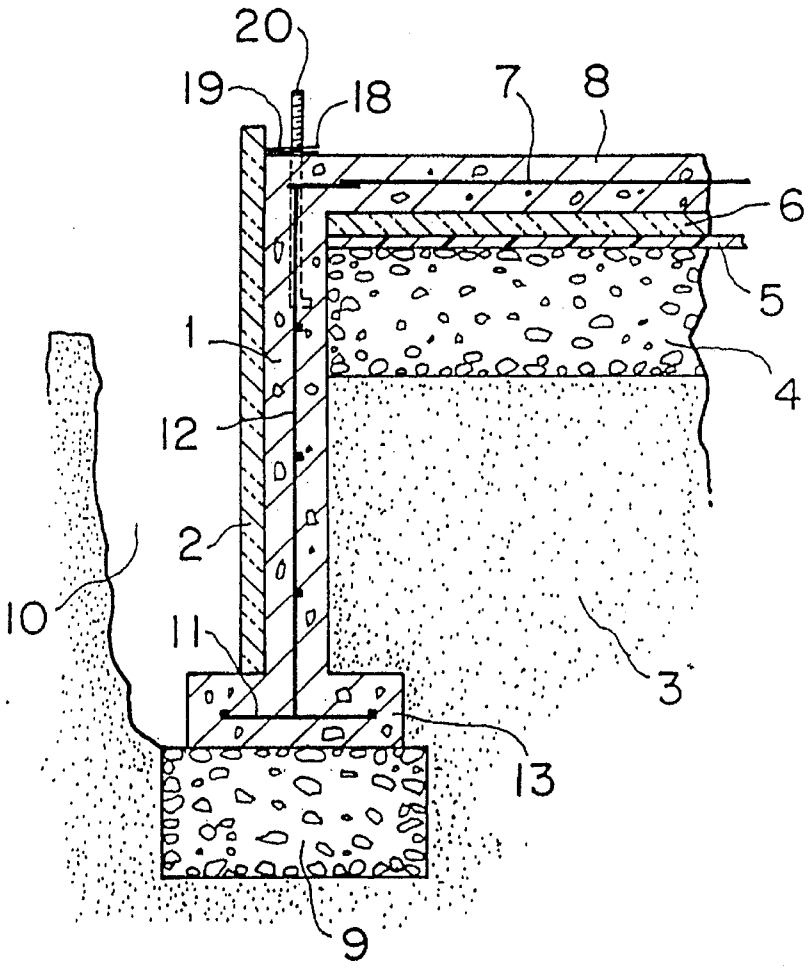
FIGS. 4A and 4B are working drawings similar to those of FIGS. 3A and 3B, but with a floor slab added.
Figure 4B:
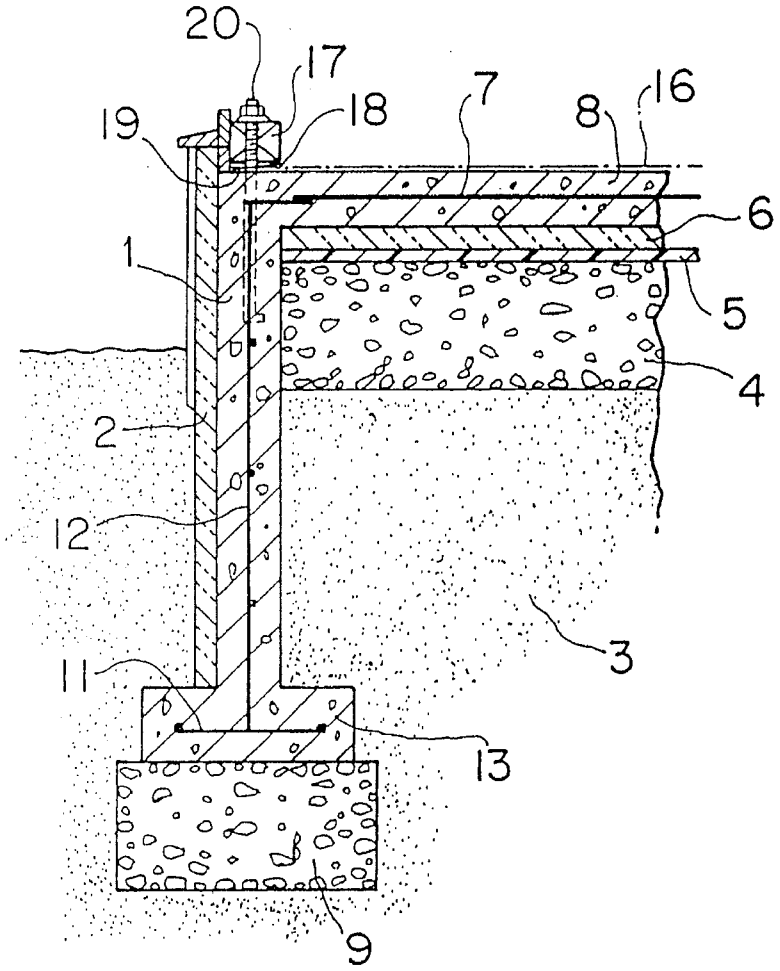

After spreading the horizontal insulation board 6 all over the moisture proof sheet 5, floor reinforcements 7 are worked on the moisture proof sheet 5 by connecting each end of the floor reinforcements 7 with the continuous footing reinforcements 12 respectively to make them integral as illustrated in FIG. 3D, after that a slab concrete is paved to make the slab integral with the continuous footing 1 wherein a slab floor 8 is completed as illustrated in FIG. 4E.

In FIG. 4F, a floor board 16 is directly spread out on the slab floor 8 and a preserved sill 17 is fixed to the continuous footing 1 by an anchor bolt 20 through a preservation material 18 such as a asphalt roofing and the like or an air seal material 19.

Figure 5:
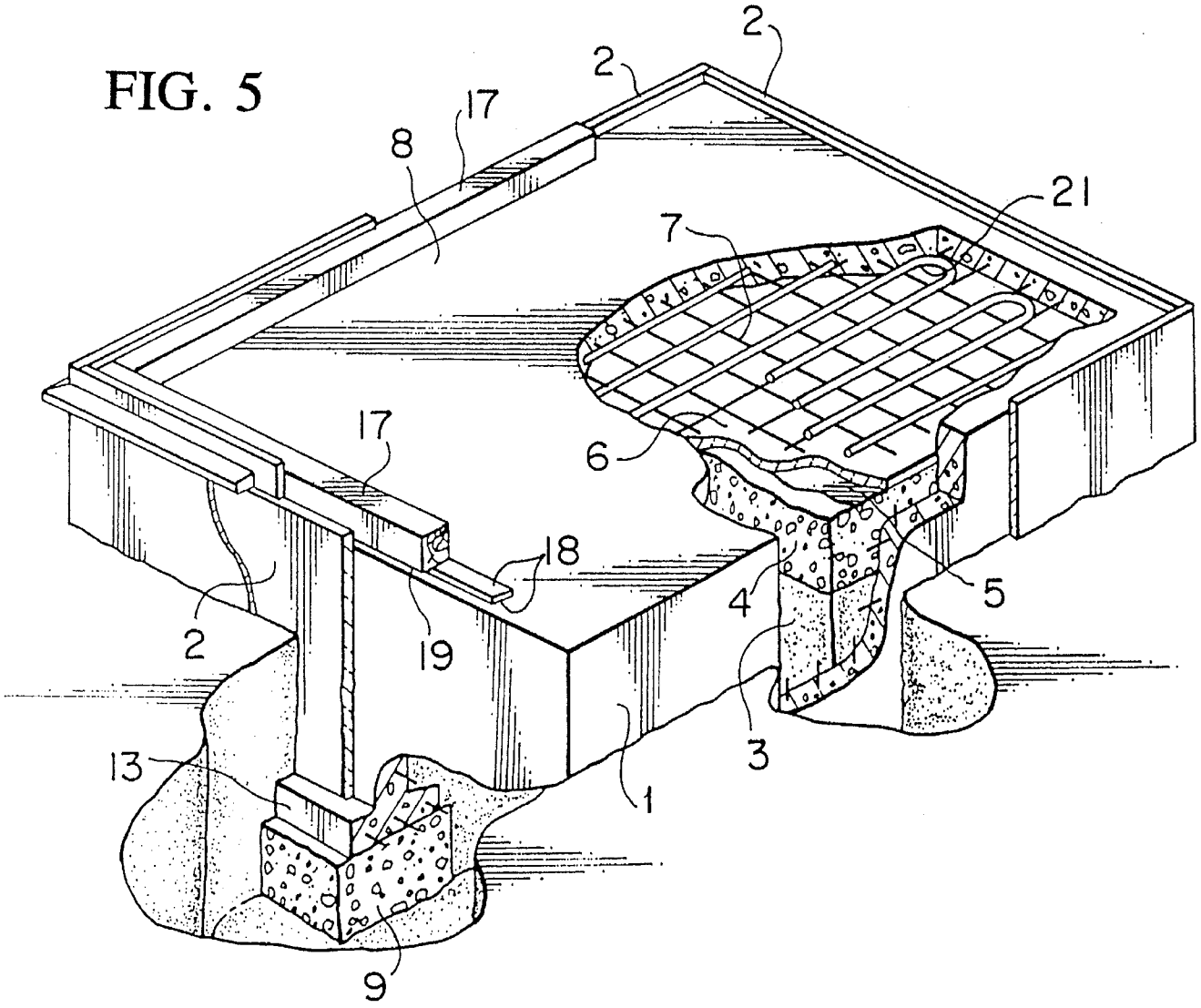
FIG.5 shows a partially vertical perspective view of a slab floor with a floor heating.
Figure 6A:
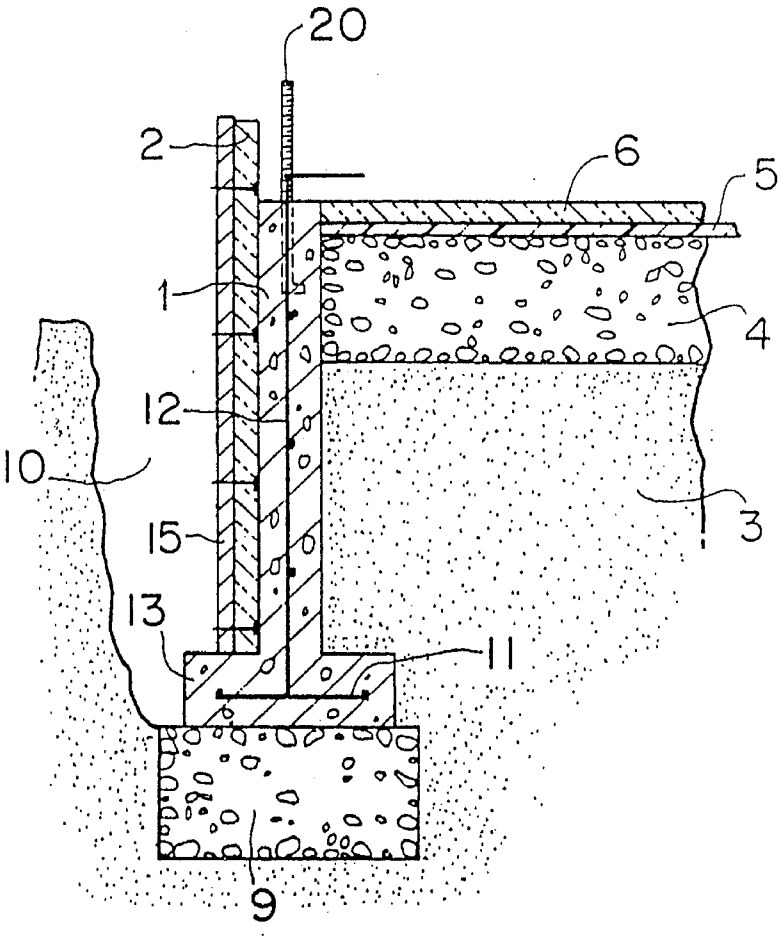
FIGS. 6A and 6B are working drawings of a continuous footing and slab floor with a floor heating.
Figure 6B:
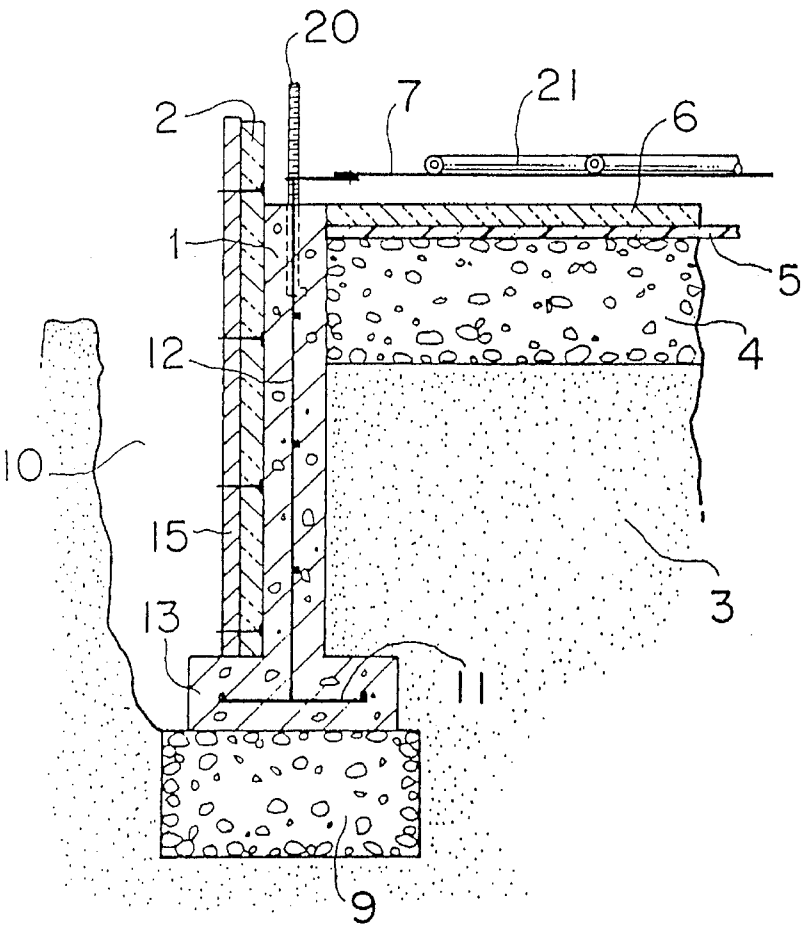
Figure 7A:
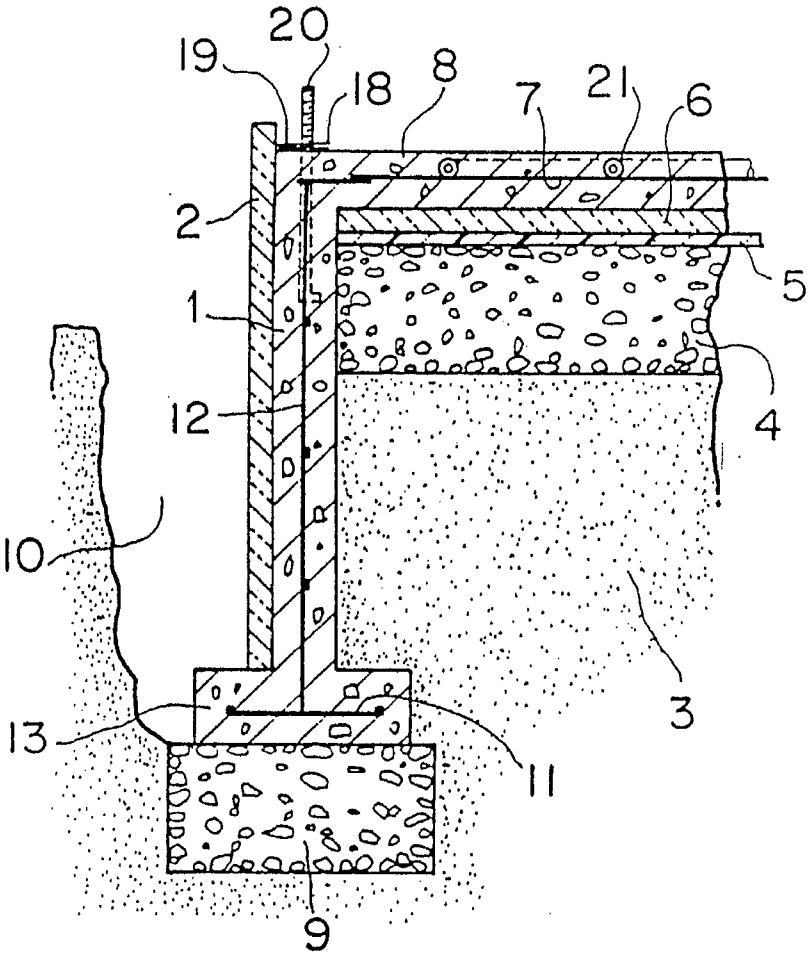
FIGS. 7A and 7B are working drawings of a continuous footing and slab floor with a floor heating.
Figure 7B:
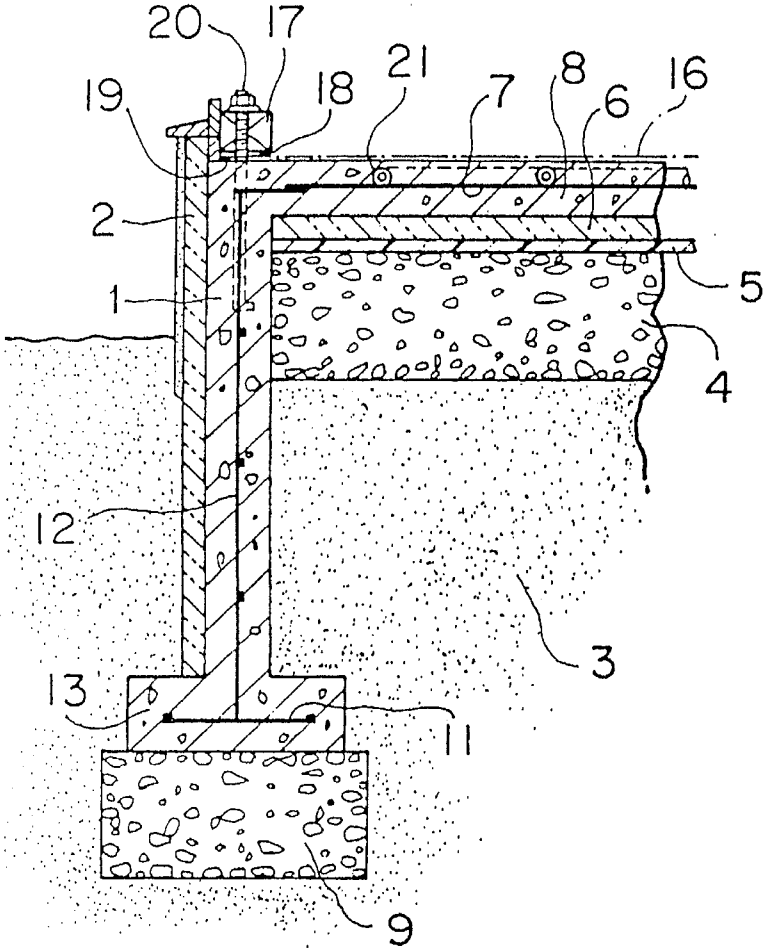

Referring now to an example adapted to a floor heating as illustrated in FIG. 5, a heating pipe 21 is stretched in a zigzag line on the floor reinforcements 7 before carrying out slab concrete work and partially connect the pipe 21 with the reinforcements 7 by a wire, thereafter the slab concrete is paved on the reinforcements 7 together with the heating pipe 21. The heating pipe 21 may be selected from a thermoplastic synthetic resin pipe with a flexibility such as a polyethylene pipe and the like.

Referring to the quality of wooden materials or timbers to be used for frameworks and building element of the present invention, all wooden materials or timbers are suggested to use a so-called kiln-dried wood which are well sawn and homogenized in a lumbering factory prior to building work wherein they are used intact in the building site. The advantages of using this kiln-dried wood are that it can proof a moisture adsorption of heat insulation boards so that improves its capabilities of heat insulation and airtightness as well as can preserve any damage caused by fungi or insect contained in wooden core since a kiln-dried wood has a good properties to minimize its shrinking, strain, deformation etc. so that the quality of the lumber is constantly stabilized.

Figure 8:
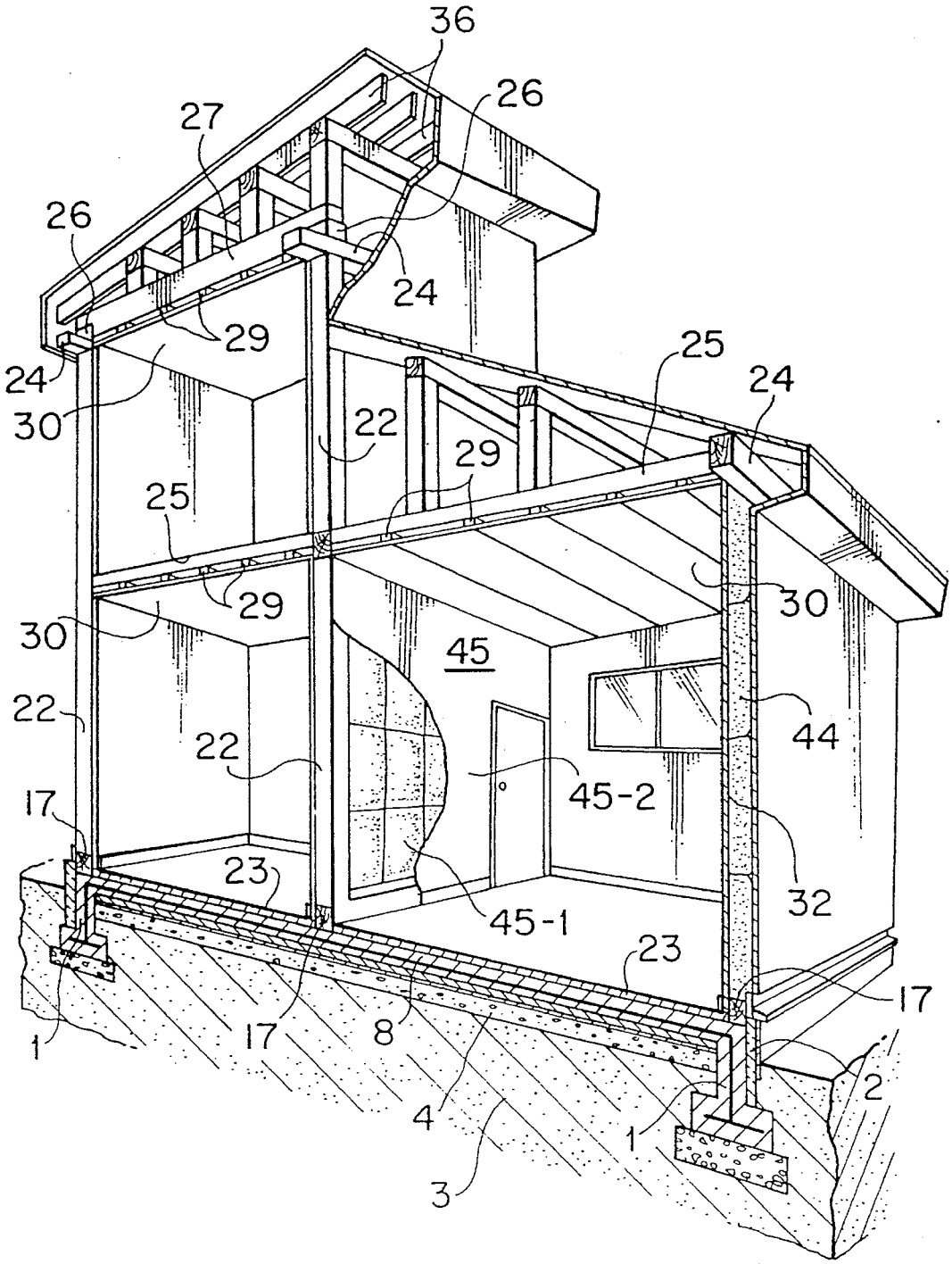
FIG. 8 shows a vertical perspective view of an example of a wooden building constructed by a framework of the present invention.
Figure 9:
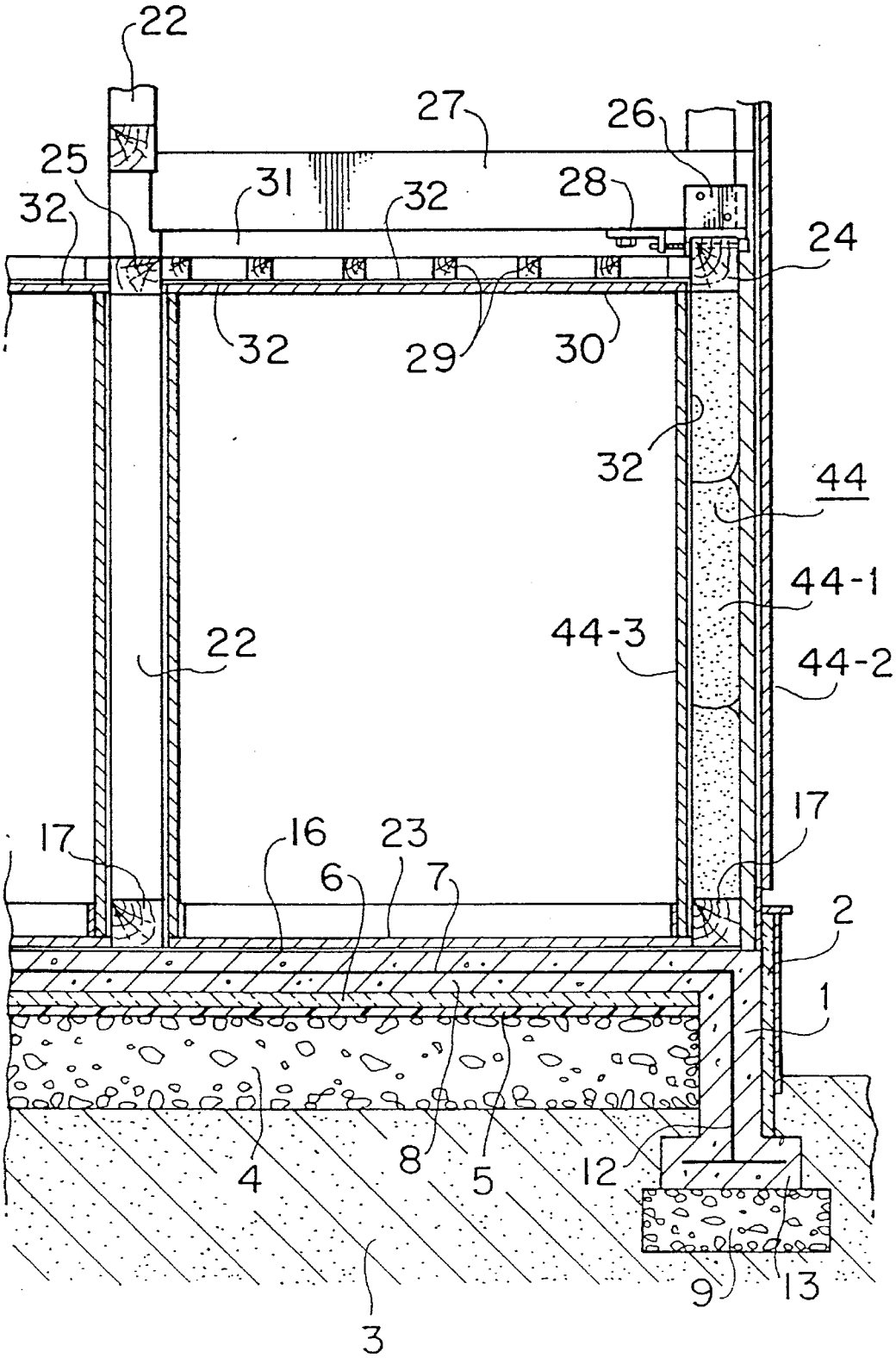
FIG. 9 shows a partially enlarged vertical section of a wooden building in FIG. 8.
Figure 10:
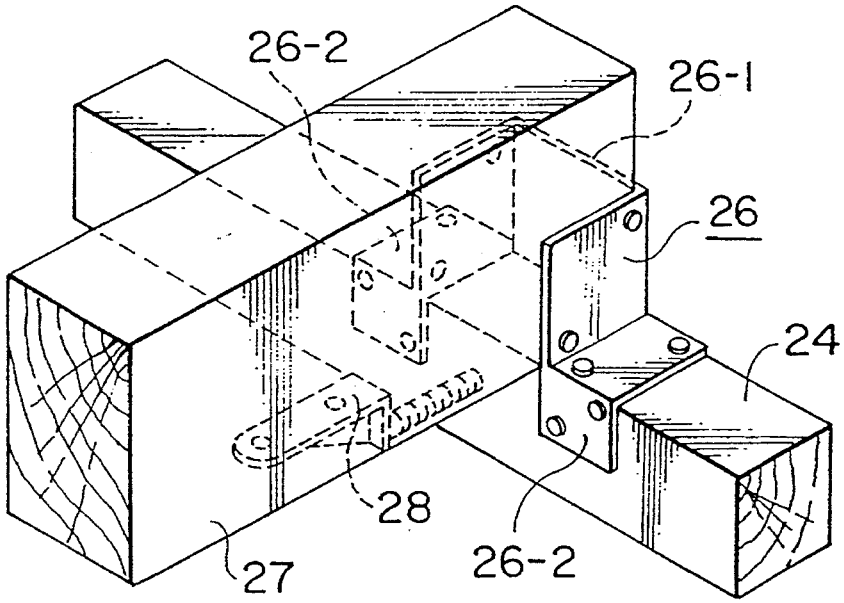
FIG. 10 shows a partially enlarged perspective view of a fixing means for beam.

In FIG. 8 to FIG. 10, it is referred to the frameworks of the present invention. As previously described in FIG. 4F, a floor board 16 is directly spread out on the slab floor 8 and a sill 17 is fixed to the continuous footing 1 by an anchor bolt 20 through a preservation material 18 such as a asphalt roofing and the like or an air seal material 19, and a plurality of columns 22 are erected on the sills 17. A finishing floor 23 is further scheduled to cover on the floor board 16 in the finishing stage of construction.

After the erection of columns 22 on sills 17, cross-beam elements 24 and partition cap elements 25 are mounted on the top end of columns 22 and they are fixed each other by using metallic joint parts 26 as illustrated in FIG. 10 which shows that a beam 27 is fixed on a cross-beam 24 by a metallic joint part 26. The positioning of a metallic joint part 26 onto the cross-beam 24 is suggested to perform before the loading work of a beam 27 and then the metalic joint part 26 is temporarily fixed onto the cross-beam 24 by nail or screw bolt prior to the loading work of a beam 27, to which is advantageous in view of a security in construction site since a beam is one of heavy timber.

Referring now in detail to the structure of a metallic joint part 26 in FIG. 10, this part 26 comprises a C-shape part 26-1 having a plurality of bolt holes and a pair of L-shape parts 26-2 having a plurality of bolt holes wherein opposed both side lower edges of the C-shape parts 26-1 and each upper side edge of the L-shape part 26-2 are then welded together to form a metallic joint part 26 as shown in FIG. 10.

Figure 11:
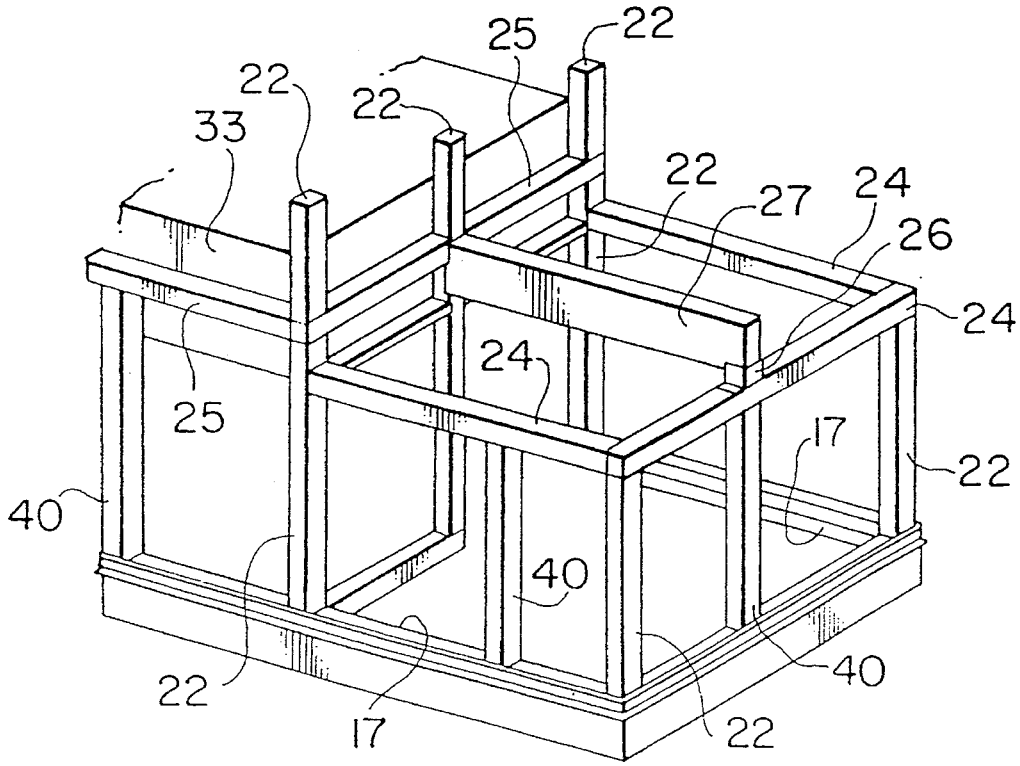
FIG. 11 is a partially perspective view for showing a process of framework of the present invention.

In the operation of the metallic joint part 26 in FIG.10 and FIG.11, after loading a beam 27 onto a cross-beam 24 or partition cap 25, one end or both ends of the beam 27 is inserted into the C-shaped box of the parts 26 and fixed to the cross-beam 24 or partition cap 25 by nails or bolts and also by a long bolt with a plate 28 after the finish of a final positioning between their configuration.

In FIG. 8 and FIG. 9, the rafters 29 of ceiling boards 30 are stretched out between cross-beams 24 each other, partition caps 25 each other, and cross-beam 24 and partition cap 25 to cover ceiling boards 30. This configuration is advantageous to minimize a gap between a ceiling 30 and a cross-beam 24 or partition cap 25 in view of an airtight structure in comparison with the conventional. A space 31 is provided to avoid that a sag of a beam 27 influences a ceiling 30.

It is referred to a process for stretching a sheet in advance of the present invention which is characterized in that the sheet proofs against any moisture intrusion from the environment as well as it keeps an airtightness of room hereinafter.

Before the stretching work of the ceiling boards 30, a moisture proof sheet 32 is covered all over the ceiling area and then ceiling boards 30 are spread out on the rafters 29 of the ceiling boards 30. The moisture proof sheet 5 may be a thermoplastic type synthetic resin sheet or film having a thickness between 0.1 mm and 1.0 mm which may be made of a vinyl chloride, a polyethylene and the like.

In the stretching work of the moisture proof sheet 32 onto the rafter 29 of the ceiling boards 30, a spare length of the sheet 32, which is more longer than the net width of the ceiling 30, is suggested to provide, and then stretched out by a tacker onto the rafter 29 while leaving both spare length portions (i.e., about 10 cm per each) so as to hang down along both side walls, and these spare length portions are overlapped with another moisture proof sheets 32 spread out on both wall surfaces and the edges of the spare length sheet are sealed by an adhesive tape to secure an airtightness of room.

In FIG. 11 to FIG. 15, it is further referred to a roof truss and roofing after the above frameworks and process for stretching a sheet in advance.

Figure 12:
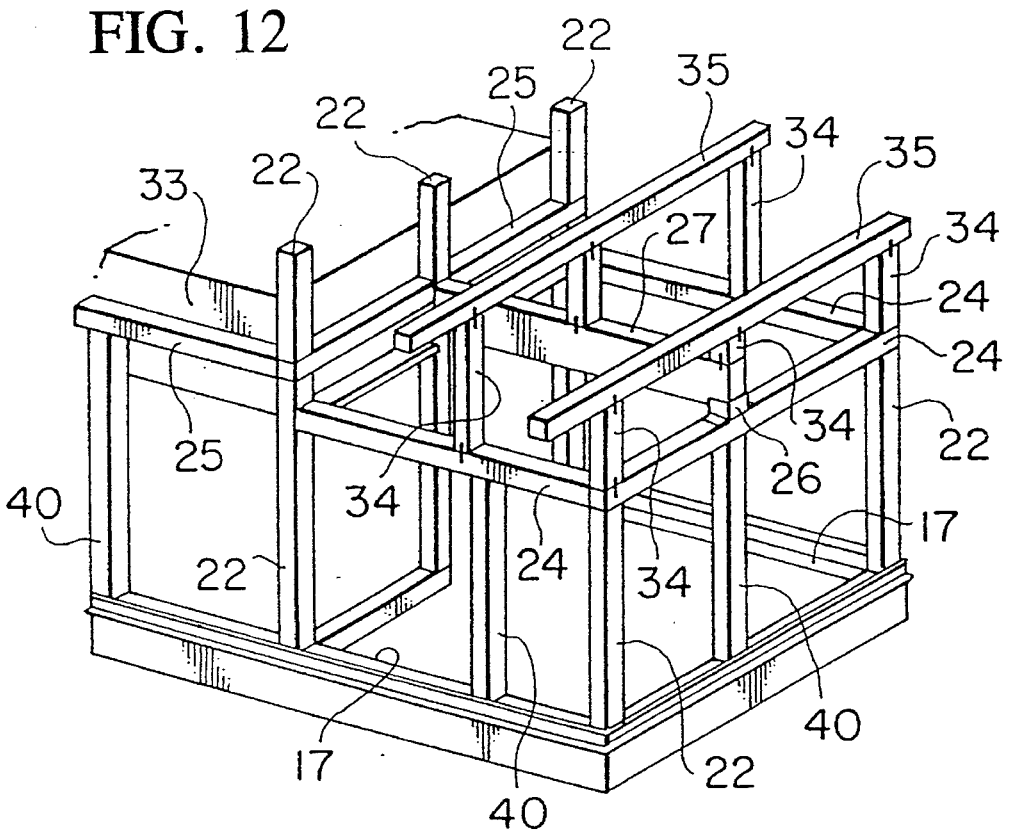
FIG. 12 is a partially perspective view for showing a process of framework of the present invention.
Figure 13:
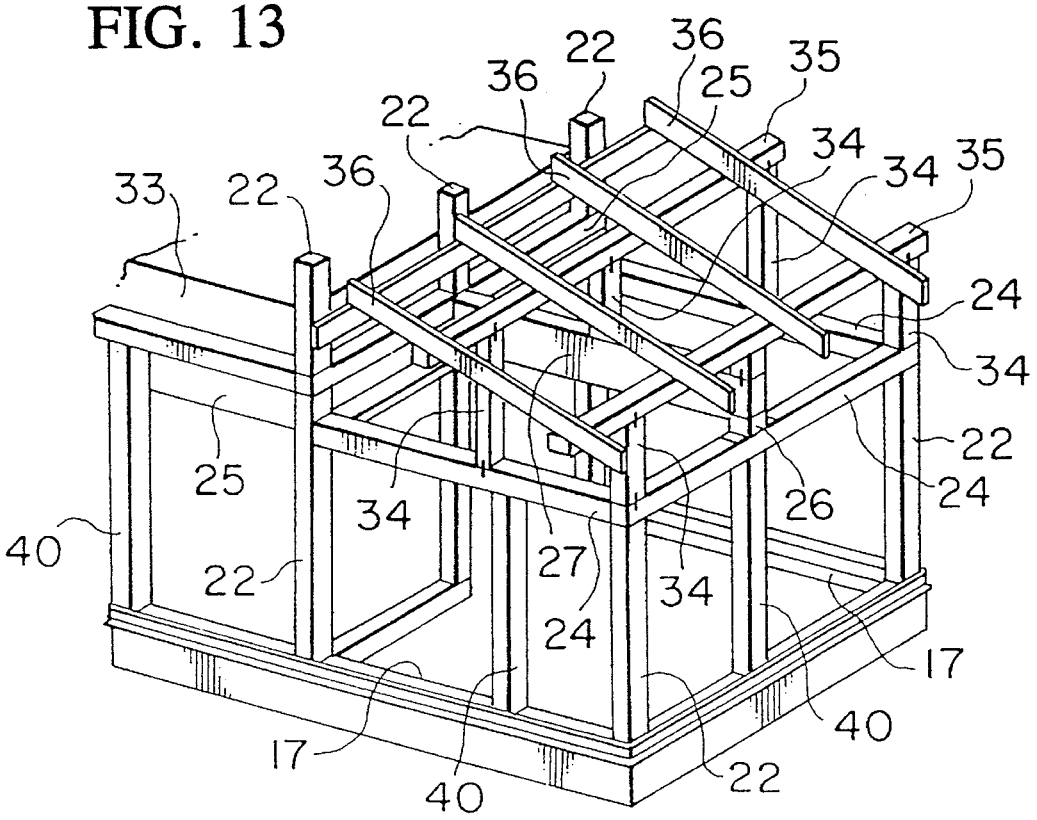
FIG. 13 is a partially perspective view for showing a process of framework of the present invention.

In FIG. 12 and FIG. 13, after the due works of the cross-beam 24, partition cap 25, beam 27 and others, struts 34 are erected as usual on the horizontal members such as the cross-beam 24, partition cap 25, beam 27 and others, and then purlin 35 are mounted as usual on the struts 34, and roof-rafters 36 are further stretched out by crossing these purlin 35.

Figure 14:
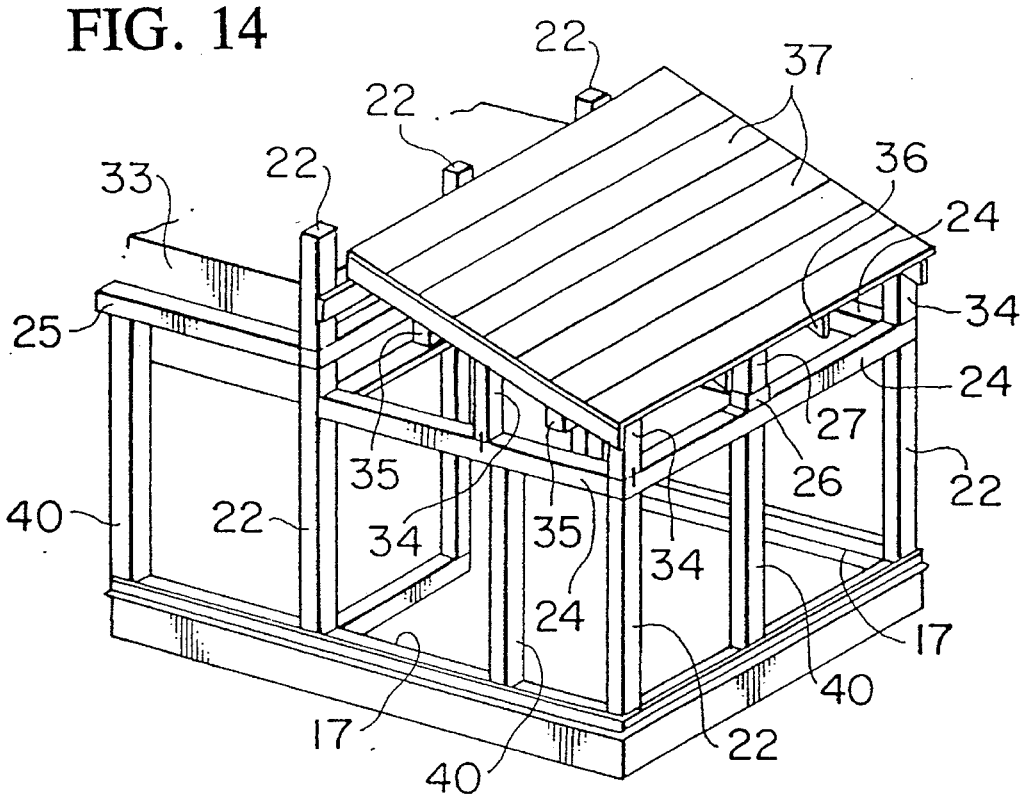
FIG. 14 is a partially perspective view for showing a process of roofing of the present invention.
Figure 15:
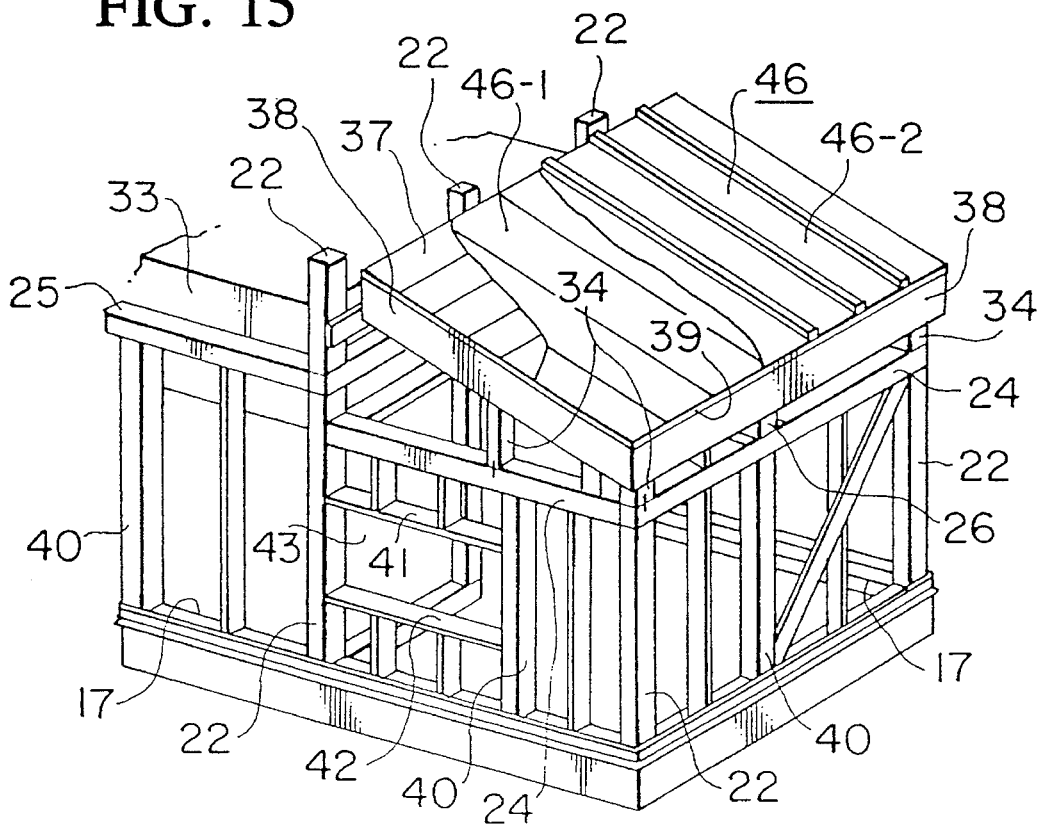
FIG. 15 is a partially perspective view for showing a process of roofing of the present invention.

In FIG. 14 and FIG. 15, upon completion of the roof truss, battens 37, fascia boards 38, cant strips 39 and others are disposed as usual. After that studs 40, diagonal bracing (not shown in the drawings), lintel 41, window sills 42, window frames 43, horizontal angle braces (not shown in the drawings) and others are arranged as usual.

In FIG. 9, it illustrates a heat insulation type outer wall 44 which comprises a heat insulation pad 44-1 such as a glass wool packed in a film bag, an exterior board 44-2, an interior board 44-3 and others.

In FIG. 8, it illustrates a heat insulation type interior wall 45 which comprises a heat insulation pad 45-1 such as a glass wool and an interior board 45-2.

In FIG. 15, a waterproofing work 46-1 is carried out upon the battens 37 by using a waterproofing sheet such as an asphalt roofing and the like and a metallic sheet 46-2 such as a vinyl chloride film coated thin steel sheet is covered on the battens 37 covered by the waterproofing sheet to form a roof 46.

In view of further improvement of heat insulation, it may be allowed to provide a glass wool heat insulation layer between the roof and ceiling, and also to blow a polyurethane foam between the roof and ceiling as a site work. In addition, the roofing of the present invention is not necessarily limited to the metallic sheet but may be allowed to use another roofing materials.

It will be apparent that the present invention, as described above, achieves to provide an improved wooden building used for a zone of cold comprising: an well insulated slab floor having both a vertically oriented heat insulation against a depth of frost penetration in the winter and a horizontal heat insulation as its slab face to proof any moisture trouble upon sills or wooden basements as well as a dew condensing trouble on the slab floor; an improved sill structure which refuses a conventional type floor space between a living floor and slab face to obstruct the heat insulation and moisture proof; an improved frameworks which can reduce a gap or difference in grade between cross-beam and ceiling or partition cap and ceiling by making low the level of the cross-beam or partition cap to the top end of columns, to which is effective for intensifying an airtightness of the whole building by using a moisture proof sheet in advance.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A connector for connecting together wooden beams in a house construction comprising:

a joint part including a C-shaped member having opposed side walls having openings therein to receive first beam fasteners therethrough, and a rear wall interconnecting said side walls, said side walls and rear wall surrounding an interior space of said C-shaped member, said joint part further including respective outwardly extending members each having a first substantially planar element perpendicularly extending from a respective side wall along an edge of said side wall perpendicular to said rear wall to extend away from said interior space in a direction perpendicular to said opposed side walls, each first planar element having openings therein to receive second beam fasteners therethrough; and a plate member with a long bolt for use in conjunction with said joint pan upon placement parallel to said substantially planar elements and extending away from said interior space in a direction perpendicular to said rear wall;

wherein said joint part and said plate member are used in conjunction to connect a free end of a beam to a cross-beam by: placing said outwardly extending members over a top surface of the cross-beam so that said C-shaped member extends away from the top surface of the cross-beam, placing the free end of the beam within said interior space of said C-shaped member so that the free end is adjacent said rear wall and rests on the cross-beam, and inserting said long bolt into the cross-beam with said plate member beneath and supporting the beam.

2. A connector as in claim 1, wherein each of said outwardly extending members further comprises a second substantially planar element perpendicularly extending along an edge of said first element parallel to and spaced apart from said rear wall to extend away from said interior space, said second element being positioned to abut a surface of the cross-beam perpendicularly extending downwardly from the top surface when said first element is positioned over the top surface of the cross-beam.

3. A connector as in claim 2, wherein said openings are provided in said first and second planar elements to receive fasteners therethrough.

4. A method of connecting a beam to a cross-beam or a partition cap with a joint part, said joint part comprising:

a C-shaped part having a rear wall with first and second ends and a pair of substantially parallel first and second walls, said first wall extending from said first end and said second wall extending from said second end, each of said parallel walls having an edge extending perpendicularly away from said rear wall and a plurality of bolt holes, said rear wall and said first and second parallel walls forming a C-shaped box; and a pair of first and second L-shaped parts having first and second substantially perpendicular walls and a plurality of bolt holes in each perpendicular wall, said first perpendicular wall of said first L-shaped part coupled to and extending perpendicular to said first parallel wall of said C-shaped part along said perpendicular edge with said second perpendicular wall of said first L-shaped part extending perpendicularly away from said first parallel wall and parallel to and spaced apart from said rear wall of said C-shaped part, and said first perpendicular wall of said second L-shaped part coupled to and extending perpendicular to said second parallel wall of said C-shaped part along said perpendicular edge with said second perpendicular wall of said second L-shaped part extending perpendicularly away from said second parallel wall and parallel to and spaced apart from said rear wall of said C-shaped part; wherein said method comprises the steps of:

placing said first and second L-shaped parts over a cross-beam or partition cap so that the perpendicular walls of said L-shaped parts are adjacent perpendicular sides of the cross-beam or partition cap and extend outwardly from a surface of the cross-beam or partition cap and said C-shaped part extends outwardly and upwardly from a top surface of the cross-beam or partition cap; and inserting the end of a beam into the C-shaped box of the joint part to rest on the upper surface of the cross-beam or partition cap so that the end of the beam is adjacent said rear wall and said first and second parallel walls are adjacent opposite sides of the beam further comprising the steps of: providing a plate member with long bolt; and inserting said long bolt into said cross-beam or partition cap so that said plate member is below and supporting said beam.

* * * * *